US011352893B2

(12) United States Patent
Kreibich et al.

(10) Patent No.: US 11,352,893 B2
(45) Date of Patent: Jun. 7, 2022

(54) GAS TURBINE BLADE OR COMPRESSOR BLADE HAVING ANTI-FRETTING COATING IN THE BLADE ROOT REGION AND ROTOR

(71) Applicant: Siemens Energy Global GmbH & Co. KG, Munich (DE)

(72) Inventors: Toni Kreibich, Berlin (DE); Ronald Wallstabe, Berlin (DE)

(73) Assignee: SIEMENS ENERGY GLOBALL GMBH & CO. KG

( * ) Notice: Subject to any disclaimer, the term of this patent is extended or adjusted under 35 U.S.C. 154(b) by 17 days.

(21) Appl. No.: 15/752,895

(22) PCT Filed: Aug. 19, 2015

(86) PCT No.: PCT/EP2015/069013

§ 371 (c)(1),
(2) Date: Feb. 15, 2018

(87) PCT Pub. No.: WO2017/028912

PCT Pub. Date: Feb. 23, 2017

(65) Prior Publication Data

US 2018/0245475 A1 Aug. 30, 2018

(51) Int. Cl.
*F01D 5/30* (2006.01)
*F04D 29/34* (2006.01)

(52) U.S. Cl.
CPC ..... *F01D 5/3092* (2013.01); *F04D 29/34* (2013.01); *F05D 2220/32* (2013.01); *F05D 2300/611* (2013.01)

(58) Field of Classification Search
CPC .... F01D 5/3092; F04D 29/34; F05D 2220/32; F05D 2300/611
See application file for complete search history.

(56) References Cited

U.S. PATENT DOCUMENTS 4,471,008 A 9/1984 Huther
4,790,723 A * 12/1988 Wilson ..... C04B 37/008 416/213 R
4,820,126 A * 4/1989 Gavilan ..... F01D 5/3092 416/221
5,087,174 A 2/1992 Shannon et al.
5,160,243 A * 11/1992 Herzner ..... F01D 5/28 416/220 R (Continued)

FOREIGN PATENT DOCUMENTS

EP 2511480 A2 10/2012

OTHER PUBLICATIONS

PCT International Search Report dated Apr. 26, 2016 corresponding to PCT International Application No. PCT/EP2015/069013 filed Aug. 19, 2015.

(Continued)

*Primary Examiner* — Eldon T Brockman
(74) *Attorney, Agent, or Firm* — Schmeiser, Olsen & Watts LLP

(57) ABSTRACT

The use of a polymer coating in the carrying flank region minimizes damages. Moreover, a long-term separating effect between the components, e.g. rotor blade and rotor disk, is ensured. According to the embodiments, the rotor disk groove can alternatively also be coated in whole or in part.

18 Claims, 1 Drawing Sheet

(56) References Cited

U.S. PATENT DOCUMENTS

| | | | | |
|---|---|---|---|---|
| 5,179,153 | A * | 1/1993 | George | C08K 3/04 524/495 |
| 5,356,545 | A * | 10/1994 | Wayte | C10M 169/04 508/138 |
| 5,573,377 | A * | 11/1996 | Bond | F01D 5/147 416/219 R |
| 6,102,664 | A * | 8/2000 | Nguyen | F01D 5/26 416/248 |
| 6,290,466 | B1 * | 9/2001 | Ravenhall | F01D 5/282 416/219 R |
| 8,801,385 | B2 * | 8/2014 | Fabre | F01D 5/3092 416/221 |
| 10,519,788 | B2 * | 12/2019 | Li | F01D 5/3084 |
| 2009/0016890 | A1 * | 1/2009 | Douguet | F01D 5/3092 416/219 R |
| 2010/0178169 | A1 | 7/2010 | Webb | |
| 2011/0000183 | A1 | 1/2011 | Dimelow et al. | |
| 2011/0142678 | A1 * | 6/2011 | Santiago | F03D 80/30 416/241 R |
| 2011/0206530 | A1 * | 8/2011 | Fabre | F01D 5/3007 416/229 R |

OTHER PUBLICATIONS

International Search Report for PCT/EP2015/069013.
Non-English Chinese Office Action dated Sep. 24, 2019 for Application No. 201580082510.0.

* cited by examiner

GAS TURBINE BLADE OR COMPRESSOR BLADE HAVING ANTI-FRETTING COATING IN THE BLADE ROOT REGION AND ROTOR

CROSS-REFERENCE TO RELATED APPLICATIONS

This application claims priority to PCT Application No. PCT/EP2015/069013, having a filing date of Aug. 19, 2015, the entire contents of which are hereby incorporated by reference.

FIELD OF TECHNOLOGY

The following relates to a gas turbine blade or a compressor blade having a polymer coating in the securing region, and to a rotor.

BACKGROUND

In general, a rotor blade is connected to a rotor disk by a corresponding slot in a form-fitting manner in the slot region or securing region. The rotor blades are installed and removed in the axial slot direction.

During operation, rotor blades are loaded both by the centrifugal force, as a function of rotor blade weight and rotational speed, and by the aerodynamic forces. These forces must be absorbed in the contact region between the blade root and the rotor disk slot, the so-called pressure face region.

Over the course of the life of the compressor, the following damage mechanisms can occur in the region of the pressure faces of the compressor rotor blade roots and the rotor disk slots: fretting and/or fretting fatigue, and local adhesion/cold welding and, as a consequence, transfer of material with subsequent scoring/galling on removal of the blade. Removal of rotor blades, which is necessary for maintenance purposes, can be made more difficult by the latter-mentioned damage mechanisms.

These damage mechanisms can arise fundamentally in axial-flow compressors, in the contact region between the rotor blade and the rotor disk slot, in which the rotor blades are connected in a form-fitting manner to the rotor disk. Depending on the severity, these results make it necessary to repair or replace the damaged components, which is associated with additional costs.

The coatings generally used hitherto for reducing or preventing fretting results are metallic, e.g. CuNiIn or NiTiCr. The methods used for this are for example cold gas spraying, flame spraying and plasma spraying such as HVOF (high velocity oxygen fuel spraying) or APS.

The operating principle of these coating systems with respect to anti-fretting relies in essence on their deformability (low shear strength). Thus, the input of energy due to relative movement is reduced by a low coefficient of friction between the rotor blade and rotor disk slot components, and possible fretting and thus also fretting fatigue is reduced.

A drawback of the coatings used hitherto is that the components of the coating are metallic, as is the material of the rotor disk. This means that similar materials are in contact with one another, which promotes adhesion/cold welding. As a consequence, problems can arise during installation/removal in spite of the CuNiIn coating in the contact region. Furthermore, damage to the coatings used hitherto can be repaired only with great difficulty.

The embodiments therefore have the object of solving the aforementioned problems.

SUMMARY

An aspect relates to a turbine blade or compressor blade.

BRIEF DESCRIPTION

Some of the embodiments will be described in detail, with references to the following figures, wherein like designations denote like members, wherein.

DETAILED DESCRIPTION

The figures and the description represent only exemplary embodiments of the invention.

Figure 1:
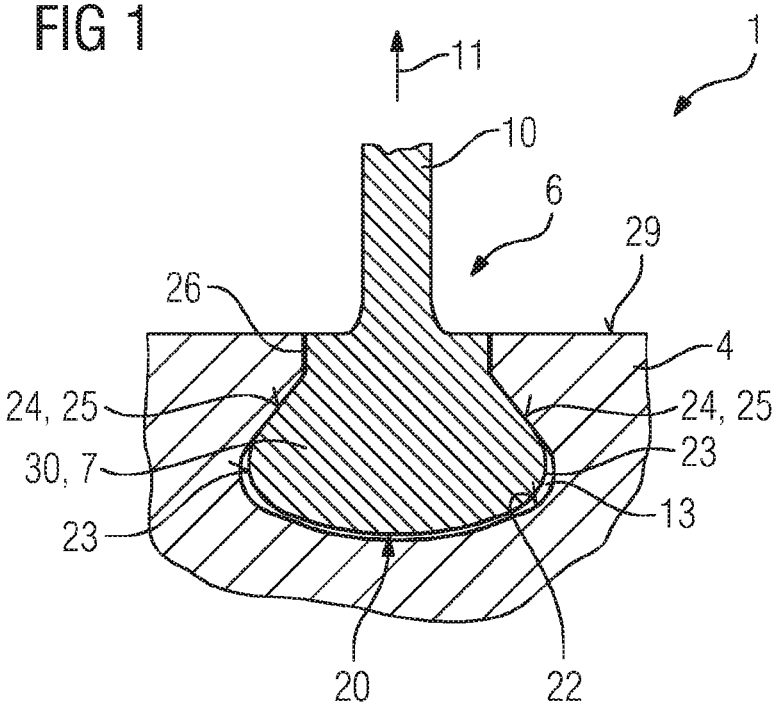
FIG. 1 is a view of an installed turbine blade or compressor blade.

FIG. 1 shows part of a rotor 1 which has a rotor disk 4 comprising, in the rotor disk 4, a slot region 13 in which there is arranged a turbine blade 6 or a compressor blade 6. A blade root 7 of the blade 6 is inserted into the slot region 13.

A blade airfoil 10 of the blade 6 projects out beyond an outer surface 29 of the rotor disk 4.

As seen in the longitudinal direction 11 of the blade 6, the blade root 7 has a lower region 20 which has a slight convex curvature.

Adjoining either side of the lower, relatively flat region 20 is a region 23 having greater, also convex, curvature.

Adjoining the more curved region 23 is a pressure face region 24 that comes into contact with the rotor disk 4.

The pressure face region 24 is planar.

Optionally adjoining the pressure face region 24 is a further end region 26 which may have various designs and in this case runs perpendicular to the surface 29 of the rotor disk 4.

The pressure face region 24, most particularly the entire blade root 20, 23, 24, 26, in particular excepting the end face 30 of the blade root 7, in particular of compressor rotor blades, is provided with a polymer coating 25.

The polymer coating 25 then preferably extends over the entire axial length of the blade root 7.

Equally, an inner surface 22 of the slot region 13, that is to say the rotor disk 4, can have a polymer coating. This polymer coating can be present in addition to the polymer coating 25 of the blade 6, or as an alternative thereto. It then also preferably extends over the entire axial length of the slot region 13.

This coating is preferably based on one or more fluoropolymers, e.g. polytetrafluoroethylene (PTFE), perfluoroalkoxy (PFA), perfluoroethylenepropylene (FEP).

Furthermore, it is also preferable for one or more solid lubricants, which are embedded in the matrix of the polymer coating 25 of the blade 6 or of the slot region 13, to be present.

In the pressure face region 24 of rotor blades 6, these coating systems can reduce the input of energy due to relative movement between the rotor blade and rotor disk slot components, and reduce or prevent possible fretting and thus also fretting fatigue.

They also prevent, by virtue of different material classes (coating: polymer, rotor disk: metal, for example steel) and the solid lubricants optionally embedded in the polymer coating, adhesion/cold welding in the pressure face region of the blade root and the rotor disk slot. This ensures simple installation/removal of the rotor blades 6. A long-term separating effect is ensured in contrast to the lubricants used in the context of installation/removal. Furthermore, repair/reconditioning of operationally stressed blades 6 having a coating in the root region 7 is possible on-site with no greater additional effort.

The limiting factor for the proposed polymer-based coating 25 is the operational temperature. In the case of compressors, depending on the compressor characteristic variables, this might permit use only in forward compressor stages, and, in the case of turbines, depending on the turbine characteristic variables, use only in rear turbine stages. Future developments might broaden the field of application by raising the operational temperature.

The inventive step lies in the use of polymer-based coating systems in the region of the compressor rotor blades 6 in order to reduce or prevent fretting and fretting fatigue, and also to prevent adhesion/cold welding over the entire service life and thus to prevent consequent secondary damage during removal. In contrast to the current state of the art, a long-term separating effect between the rotor blade 6 and the rotor disk slot 13 in the pressure face region 24 is made possible, and the load-bearing behavior is improved.

The described embodiments has the following advantages over the rotor blade coating used hitherto in the root region 7, or over compressor rotor blades 6 which are uncoated in the region of the blade root 7 or the pressure face region 24:

a long-term separating effect between the blades 6 and rotor disk 4 components in the slot region 13 and thus prevention of adhesion/cold welding (during installation, operation and removal) and fretting and fretting fatigue in the pressure face region (during operation);

installation/removal is simplified by the coating;

more evenly distributed compressive stress in the pressure face region 24, i.e. reduction in localized stress concentrations, as a consequence of the polymer-based coating having a lower Young's modulus than the base material (steel);

more cost-effective coating material 25 in comparison to CuNiIn and similar coating systems more cost-effective application method, e.g. using an airbrush, in comparison to plasma flame spraying for e.g. CuNiIn and similar coating systems;

reconditioning of operationally stressed blades 6 is possible on-site with no additional effort improved damping behavior (depending on the thickness of the coating);

additional passive corrosion protection for the rotor blade 6 when coated; and possibly the option of dispensing with additional lubricant during assembly.

Figure 2:
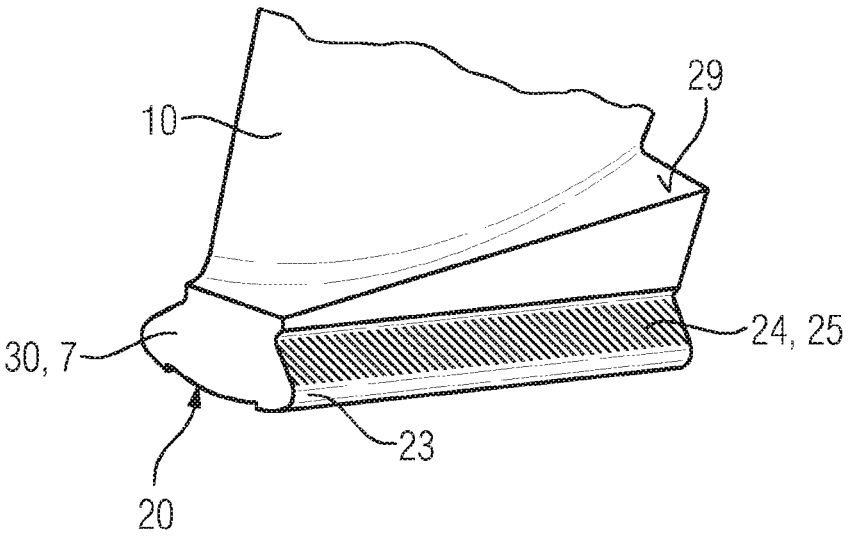
FIG. 2 is a three-dimensional illustration of a turbine blade or compressor blade.

FIG. 2 is a three-dimensional illustration of a turbine blade 6 or compressor blade 6. Since, as described above, the pressure face region 24 is particularly subject to damage, in particular only this region is coated with a polymer 25. The polymer coating 25 preferably extends over the entire axial length of the pressure face region 24 and can also encompass the entire root region 20, 23, 24, 26.

The polymer coating 25 for the blade root 7 or the slot region 13 can be fluoropolymer-based and also, in particular, contain one or more solid lubricants.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

The invention claimed is:

1. A gas turbine blade or compressor blade comprising:

a blade root having two pressure face flank regions configured to contact a slot region of a rotor disk when the blade root is inserted therein;

wherein only the two pressure face regions have a polymer coating based on perfluoroethylenepropylene applied at least partially thereto, and wherein the polymer coating includes one or more solid lubricants embedded in a matrix of the polymer coating, and wherein the polymer coating is configured to prevent cold welding over the entire service life of the rotor.

2. The gas turbine blade or the compressor blade as claimed in claim 1, in which the polymer coating is present on an entire blade root region and not on an end face of the blade root.

3. The gas turbine blade or the compressor blade as claimed in claim 1, in which the polymer coating extends over an entire axial length of the pressure face flank region.

4. The gas turbine blade or the compressor blade as claimed in claim 1, in which the polymer coating is a fluoropolymer.

5. The gas turbine blade or the compressor blade as claimed in claim 1, in which the polymer coating on the gas turbine blade or the compressor blade contains one or more solid lubricants.

6. The gas turbine blade or the compressor blade as claimed in claim 1, wherein the polymer coating is configured to reduce or prevent fretting and fretting fatigue between the blade root and a rotor disk.

7. The gas turbine blade or the compressor blade as claimed in claim 1, wherein the polymer coating is configured to prevent adhering of the blade root to the rotor disk over the entire service life of the compressor blade.

8. The gas turbine blade or compressor blade of claim 1, wherein the polymer coating is configured to reduce the input of energy due to relative movement between the blade root and the slot region of the rotor disk.

9. The gas turbine blade or compressor blade of claim 1, wherein the polymer coating is further configured to prevent damage during removal of the blade root from the slot region of the rotor disk.

10. A rotor comprising:

a rotor disk having a slot region; and a turbine blade or compressor blade having a blade root with at least one pressure face flank region and, wherein the rotor has a polymer coating based on perfluoroethylenepropylene in the slot region of the rotor disk or of the turbine blade or the compressor blade, wherein the polymer coating is applied only at the at least one pressure face flank region or an portion of the slot region that contacts the at least one pressure face flank region, and wherein the polymer coating includes one or more solid lubricants embedded in a matrix of the polymer coating, and wherein the polymer coating is configured to prevent cold welding over the entire service life of the rotor.

11. The rotor as claimed in claim 10, in which the polymer coating is present on the slot region of the rotor disk.

12. The rotor as claimed in claim 10, in which the polymer coating is present only in the slot region and only on the rotor disk.

13. The rotor as claimed in claim 10, in which the polymer coating extends over an entire axial length of the slot region.

14. The rotor as claimed in claim 10, in which a polymer in the polymer coating is a fluoropolymer.

15. The rotor as claimed in claim 10, wherein the polymer coating is configured to reduce or prevent fretting and fretting fatigue between the blade root and the rotor disk.

16. The rotor as claimed in claim 10, wherein the polymer coating is configured to prevent adhering between of the rotor disk to the turbine blade or the compressor blade over the entire service life of the turbine blade or compressor blade.

17. The rotor as claimed in claim 10, wherein the polymer coating is configured to reduce the input of energy due to relative movement between the blade root and the slot region of the rotor disk.

18. The rotor as claimed in claim 10, wherein the polymer coating is configured to reduce the input of energy due to relative movement between the blade root and the slot region of the rotor disk.

* * * * *